US006997744B2

(12) United States Patent
Khemakhem

(10) Patent No.: US 6,997,744 B2
(45) Date of Patent: Feb. 14, 2006

(54) TRIAXIAL BULKHEAD CONNECTOR

(75) Inventor: M'Hamed Anis Khemakhem, Minnetonka, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 11/135,910

(22) Filed: May 23, 2005

(65) Prior Publication Data

US 2005/0215115 A1 Sep. 29, 2005

Related U.S. Application Data

(62) Division of application No. 10/640,472, filed on Aug. 12, 2003.

(51) Int. Cl.
*H01R 9/05* (2006.01)

(52) U.S. Cl. ..... 439/580; 439/578; 439/544

(58) Field of Classification Search ..... 439/580, 439/578, 579, 594, 63
See application file for complete search history.

(56) References Cited

U.S. PATENT DOCUMENTS

| | | | |
|---|---|---|---|
| 3,673,546 | A | 6/1972 | Green et al. |
| 3,828,305 | A | 8/1974 | Hogendobler |
| 4,030,797 | A | 6/1977 | Nieman |
| 4,593,964 | A | 6/1986 | Forney, Jr. et al. |
| 4,674,809 | A | 6/1987 | Hollyday et al. |
| 4,813,887 | A | 3/1989 | Capp |
| 5,062,808 | A | 11/1991 | Hosler, Sr. |
| 5,281,167 | A | 1/1994 | Le et al. |
| 5,413,502 | A | 5/1995 | Wang |
| 5,417,588 | A | 5/1995 | Olson et al. |
| 5,595,499 | A | 1/1997 | Zander et al. |
| 5,660,564 | A | 8/1997 | Yamanashi et al. |
| 5,769,662 | A | 6/1998 | Stabile et al. |
| 5,893,777 | A | 4/1999 | Kantor |
| 5,967,852 | A | 10/1999 | Follingstad et al. |
| 6,024,609 | A | 2/2000 | Kooiman et al. |

(Continued)

FOREIGN PATENT DOCUMENTS

DE 37 44 796 A1 5/1989

(Continued)

OTHER PUBLICATIONS

Kings Electronics Co., Inc., Broadcast Products Catalog 801, pp. 1, 25-37, and 45-50, ©2001.

(Continued)

*Primary Examiner*—P. Austin Bradley
*Assistant Examiner*—X. Chung-Trans
(74) *Attorney, Agent, or Firm*—Merchant & Gould PC

(57) ABSTRACT

A bulkhead connector for connecting to a transmission line comprising a rear portion mounted within an opening in a bulkhead with a first end including first and second threads on a first side of the bulkhead and a second end extending through the opening to a second opposing side of the bulkhead. A front connector body and a front shell assembly are threadably attached to the rear portion with an insulator sleeve positioned between them. The front shell assembly includes a front shell with threads for attaching to the rear portion and a center conductor mounted within an insulator. The insulator is mounted within a central opening of the front shell and electrically isolates the center conductor from the front shell. The second end of the rear portion including threads received within the opening in the bulkhead.

6 Claims, 8 Drawing Sheets

U.S. PATENT DOCUMENTS

| | | | | |
|---|---|---|---|---|
| 6,109,963 | A | 8/2000 | Follingstad et al. | |
| 6,126,482 | A | 10/2000 | Stabile | |
| 6,146,192 | A | 11/2000 | Cabalka et al. | |
| 6,174,206 | B1 | 1/2001 | Yentile et al. | |
| 6,231,380 | B1 | 5/2001 | Cabalka et al. | |
| 6,551,136 | B1 | 4/2003 | Johnsen et al. | |
| 6,561,848 | B1 | 5/2003 | Khemakhem et al. | |
| 6,575,786 | B1 | 6/2003 | Khemakhem et al. | |
| 6,702,613 | B1 | 3/2004 | Khemakhem et al. | |
| 6,811,432 | B1 * | 11/2004 | Cabalka et al. | 439/540.1 |
| 2002/0025718 | A1 | 2/2002 | Cabalka et al. | |

FOREIGN PATENT DOCUMENTS

| | | |
|---|---|---|
| DE | 201 14 593 U1 | 2/2002 |

OTHER PUBLICATIONS

ADC Telecommunications, Inc., ProAx™ Triaxial Camera Connector, 8 pages, dated Jun. 1998.

ADC Telecommunications, Inc., Broadcast Products Catalog, 9th Edition, front cover, pp. 100-105, and rear cover, dated Mar. 2001.

* cited by examiner

TRIAXIAL BULKHEAD CONNECTOR

CROSS-REFERENCE TO RELATED APPLICATIONS

This application is a divisional application of U.S. application Ser. No. 10,640,472, filed Aug. 12, 2003, the disclosure of which is incorporated herein by reference.

FIELD OF THE INVENTION

The present invention relates to bulkhead connectors, more specifically to bulkhead connectors for connecting to triaxial cables.

BACKGROUND OF THE INVENTION

Connectors for use with electrically conductive triaxial transmission cables provide electrical connectivity with the center conductor of the cable as well as to coaxially arranged conductors within the cable. The center conductor of a triaxial cable is physically and electrically linked to the center conductor of the connector, and the connector can then be used with a mating bulkhead connector, such as might be found on a camera or other piece of telecommunications or entertainment broadcast equipment. U.S. Pat. Nos. 5,967,852, 6,109,963 and 6,575,786 to ADC Telecommunications, Inc., concern triaxial cable connectors for use in-line. Mounting panels for connectors of this type are also known, as shown in U.S. Pat. Nos. 6,146,192 and 6,231,380. Continued development in this area is desired.

SUMMARY OF THE INVENTION

A bulkhead connector for connecting to a transmission line comprising a rear portion mounted within an opening in a bulkhead with a first end including first and second threads on a first side of the bulkhead and a second end extending through the opening to a second opposing side of the bulkhead. A front connector body and a front shell assembly are threadably attached to the rear portion with an insulator sleeve positioned between them. The front shell assembly includes a front shell with threads for attaching to the rear portion and a center conductor mounted within an insulator. The insulator is mounted within a central opening of the front shell and electrically isolates the center conductor from the front shell. The second end of the rear portion including threads may be received within the opening in the bulkhead.

BRIEF DESCRIPTION OF THE DRAWINGS

The accompanying drawings, which are incorporated in and constitute a part of the specification, illustrate several aspects of the present invention and together with the description, serve to explain the principles of the invention. A brief description of the drawings is as follows.

DETAILED DESCRIPTION OF THE PREFERRED EMBODIMENT

Reference will now be made in detail to exemplary aspects of the present invention which are illustrated in the accompanying drawings. Wherever possible, the same reference numbers will be used throughout the drawings to refer to the same or similar parts.

Figure 1:
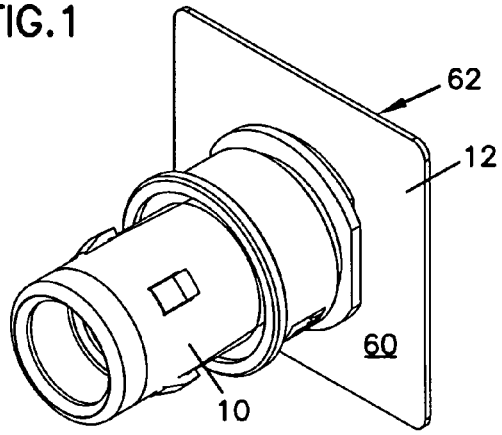
FIG. 1 is a perspective view of a triaxial bulkhead connector in accordance with the present invention mounted to a bulkhead.

Connectors for connecting two lengths of triaxial cables are known and are described in detail in U.S. Pat. Nos. 5,967,852, 6,109,963 and 6,575,786, the disclosures of which are incorporated herein by reference. Various adapters, yokes, mounting plates and bulkheads for cable connectors are disclosed in U.S. Pat. No. 6,575,786, noted above, and in U.S. Pat. Nos. 6,146,192 and 6,231,380, the disclosures of which are incorporated herein by reference. However, these prior systems did not permit the direct connection to a piece of equipment, such as a camera, without the equipment including a pigtail of cable to which a mating connector is attached. Such an arrangement may be cumbersome and more prone to damage than a bulkhead mounted connector, such as connector 10 shown in FIG. 1.

Figure 1A:
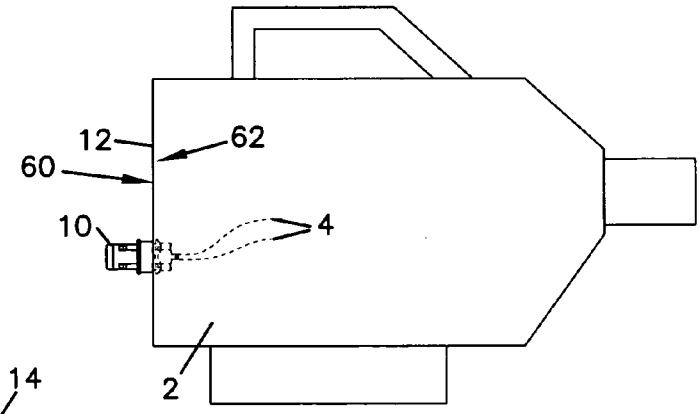
FIG. 1A is a side view of a camera with the triaxial connector of FIG. 1 mounted to the camera and hidden lines showing leads connected to the connector within the camera.

Connector 10 is adapted to mount to a bulkhead 12. In the preferred embodiment, connector 10 fits in an opening 13 in bulkhead 12 (shown in FIG. 13, below). Bulkhead 12 can be the case of a camera 2, such as shown in FIG. 1A, or some other piece of broadcast transmission equipment. Connector 10 differs from the triaxial connectors described in the referenced U.S. patents in that it is mounted directly to bulkhead 12 without yokes or adapters. Also, connector 10 is not adapted to terminate a jacketed triaxial cable. As will be shown in more detail below, connector 10 is adapted to mate with a triaxial connector on a first side 60 of bulkhead 12 (outside the camera or other equipment) while connecting with one or more electrical leads 4 or other conductors on a second opposite side 62 of bulkhead 12 (inside camera 2 or other equipment).

In the prior art systems, disclosed in the patents cited above, kits were provided to permit connectors terminating jacketed cables to be changed to mate with the style and gender of other cables or broadcast transmission equipment. This required that the connectors on the cables be of the type described in these patents. However, if the cables were not terminated with such modifiable connectors, gender or style modification to connect to a camera with a bulkhead mounted adapter was not possible without cutting off the existing connector and re-terminating the cable. Connector 10 permits the modification of a bulkhead mounted connector to mate with the style and gender of a non-modifiable cable mounted connector. This will permit greater flexibility in the use of cameras and other equipment with existing cable infrastructure, such as might be found at a sporting venue or other broadcast facility.

Figure 2:
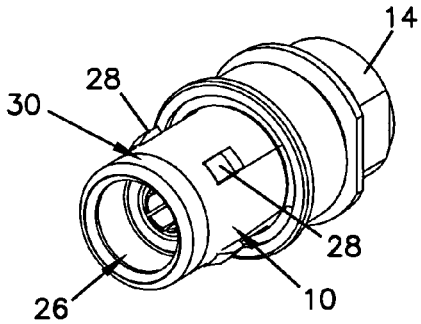
FIG. 2 is a perspective view of the bulkhead connector of FIG. 1, removed from the bulkhead.
Figure 3:
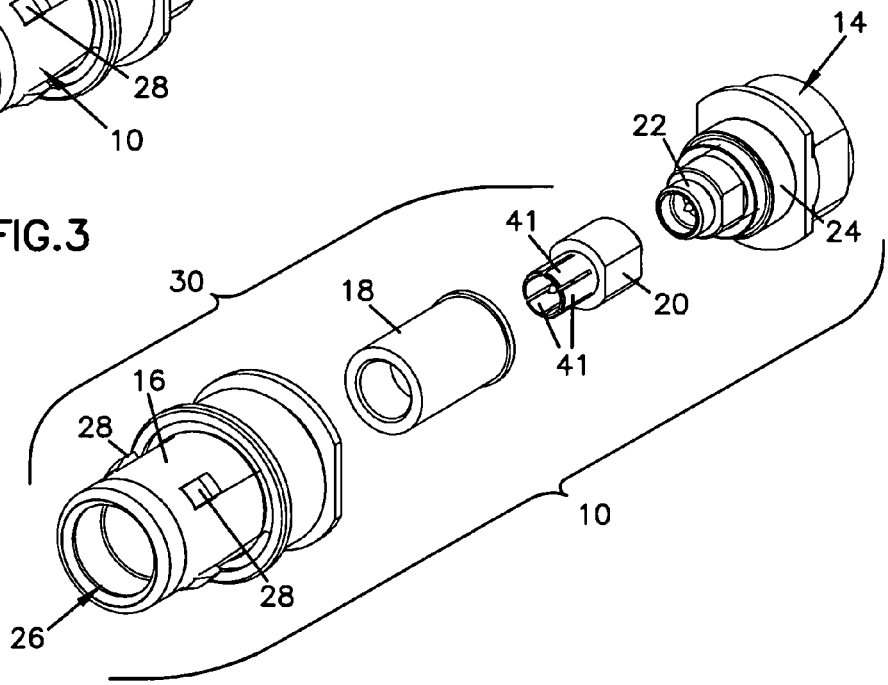
FIG. 3 is a partially exploded perspective view of the bulkhead connector of FIG. 2.

Referring now to FIGS. 2 and 3, connector 10 is a male or plug connector for mating with a female or jack cable mounted triaxial connector. Connector 10 includes a connector body or rear portion 14, which is mounted to bulkhead 12, a front shell assembly 20 which is threadably mounted to rear portion 14 at second threads 22. A front connector body 16 is threadably mounted to rear portion 14 at first threads 24 and is positioned about front shell assembly 20. Mounted between front connector body 16 and front shell assembly 20 to physically and electrically isolate the two from each other is insulator 18. Front connector body 16 defines a first end 26 and includes a plurality of releasable locking members positioned about a circumference. Locking members 28 permit the secure yet releasable connection with a mating connector.

Front connector body 16, insulator 18 and front shell assembly 20 comprise a kit 30 for adapting rear portion 14 to mate with a variety of different style or genders of triaxial connectors. Four embodiments of such kits are shown in the FIGS. corresponding to two distinct styles or formats of connectors and two genders within each style. The present invention is not limited to these four embodiments but may be adapted for use with other styles and gender definitions. Different kits 30 are described in further detail in previously incorporated U.S. Pat. Nos. 5,967,852, 6,109,963 and 6,575,786.

Figure 4:
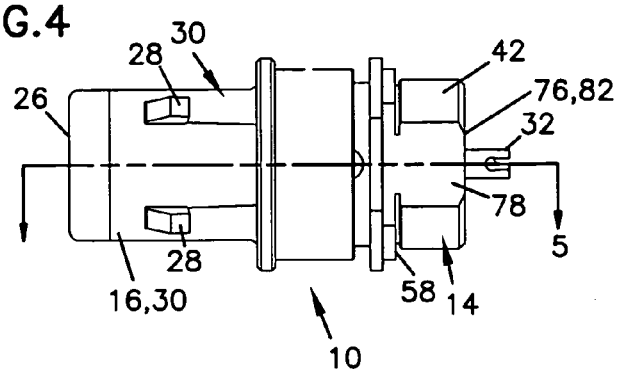
FIG. 4 is a side view of the bulkhead connector of FIG. 2.
Figure 5:
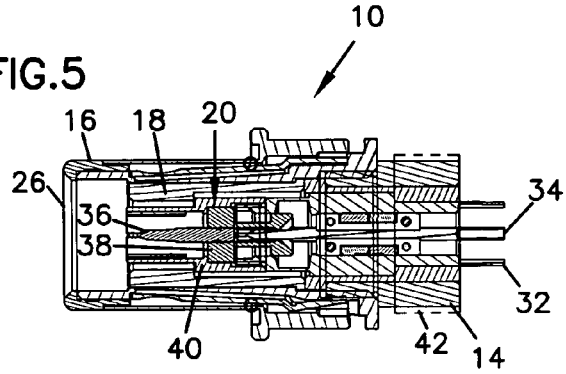
FIG. 5 is a cross-sectional view of the bulkhead connector of FIG. 4, taken along line 1—1.

Referring now to FIGS. 4 and 5, connector 10 includes a center contact mounting stud 34 which is electrically connected with a center conductor pin 36 of front shell assembly 20. When first end 26 is mated with a mating triaxial cable connector, center conductor pin 36 is electrically connected with the center conductor of the cable. Mounting stud 34 is adapted for connection with a lead within the piece of broadcast equipment of which bulkhead 12 is a part. Connector 10 also includes first coaxial conductor mounting studs 32 which are electrically connected to a front shell 40. When first end 26 is mated with a mating triaxial cable connector, front shell 40 is electrically connected to the first coaxial conductor of the cable. Mounting studs 32 are adapted for connection with a lead or leads within the piece of broadcast equipment of which bulkhead 12 is a part.

Front shell assembly 20 includes front shell 40, center conductor pin 36 and an insulator 38 positioned between and electrically and physically isolating shell 40 and pin 36. Pin 36 is mounted within a central axial opening in insulator 38 and insulator 38 is held within a central axial opening of front shell 40. Front shell 40 is threadably received by second threads 22 to mount front shell assembly to rear portion 14. Front shell 40 includes a plurality of finger 41 (shown in FIG. 3). Center conductor pin 36 is interchangeable with a center conductor jack while front shell 40 is interchangeable with a front shell defining a solid front end without fingers.

Figure 6:
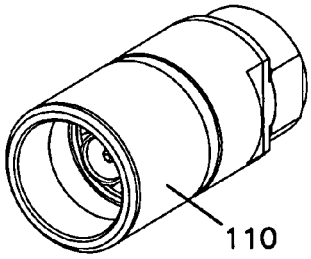
FIG. 6 is a perspective view of a second embodiment of a bulkhead connector in accordance with the present invention.
Figure 7:
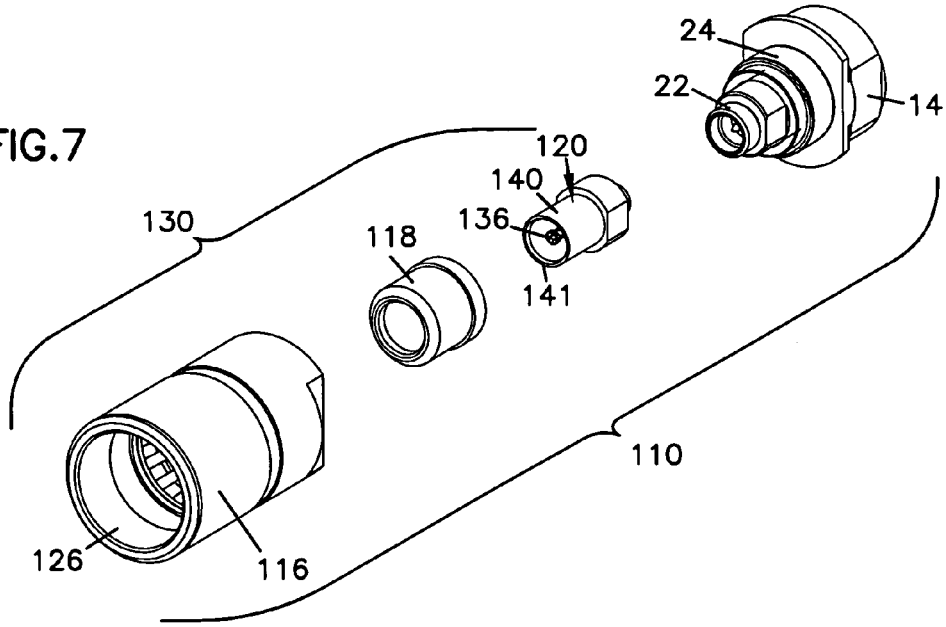
FIG. 7 is a partially exploded perspective view of the bulkhead connector of FIG. 6.
Figure 8:
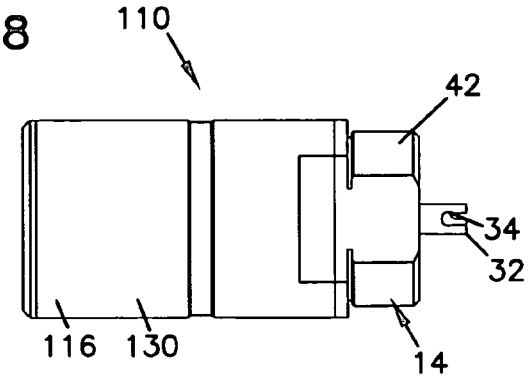
FIG. 8 is a side view of the bulkhead connector of FIG. 6.
Figure 9:
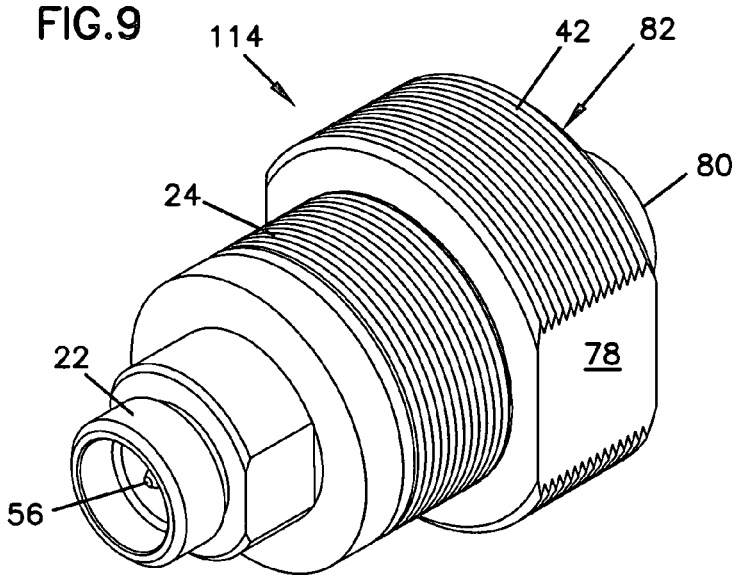
FIG. 9 is a front perspective view of a rear portion of a triaxial bulkhead connector according to the present invention.
Figure 10:
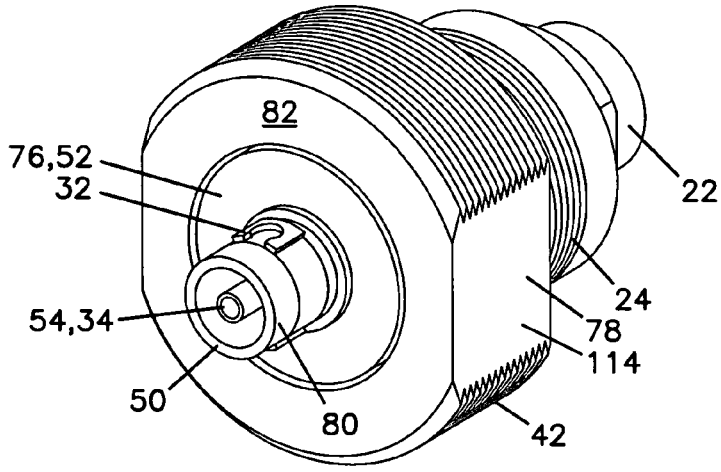
FIG. 10 is a rear perspective view of the rear portion of the bulkhead connector of FIG. 9.
Figure 11:
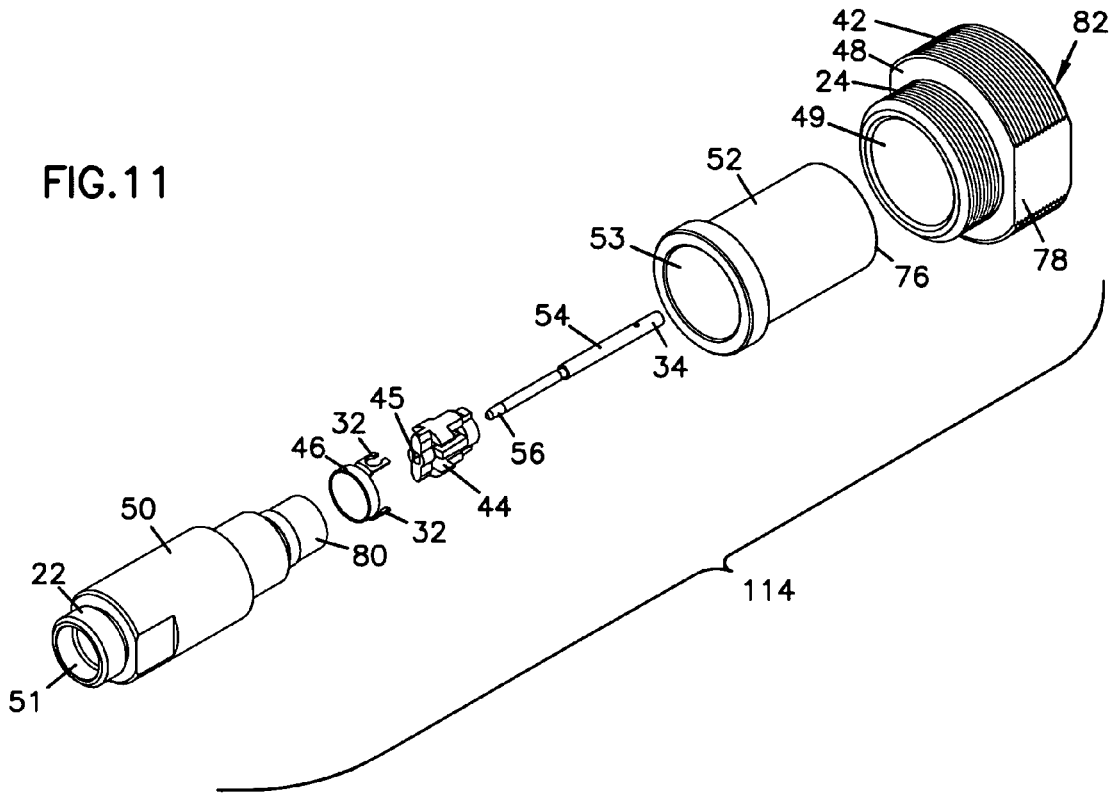
FIG. 11 is an exploded front perspective view of the rear portion of the bulkhead connector of FIG. 9.
Figure 12:
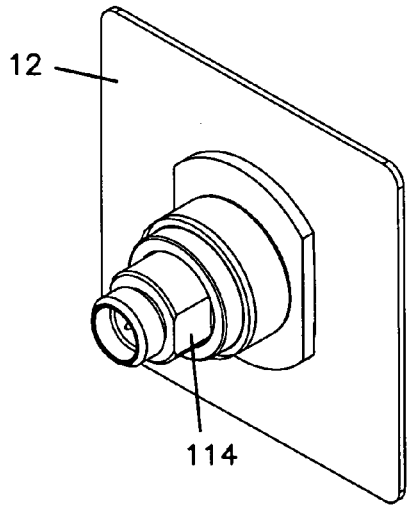
FIG. 12 is a second embodiment of a rear portion of a triaxial bulkhead connector according to the present invention, mounted to an opening in a bulkhead.

Referring now to FIGS. 6 to 8, a bulkhead connector 110 is shown. Connector 110 conforms to the same format as connector 10 but is a female or jack connector. Rear portion 14 is the same for both connectors, as indeed it is for all styles and genders of bulkhead triaxial connectors according to the present invention. A kit 130 includes a front shell assembly 120 with a front shell 140 and a center conductor jack 136. Center conductor jack 136 is held within a central axial opening of insulator 38 and insulator 38 is held within a central axial opening of front shell 140. Front shell 140 defines a solid front end 141.

Kit 130 also includes a front connector body 116 and an insulator 118 positioned between front shell assembly 120 and front connector body 116. Front shell assembly 120 is threadably received by second threads 22 and front connector body 116 is threadably received by first threads 24. Center contact mounting stud 34 is electrically connected to center conductor jack 136 and first coaxial mounting studs 32 are electrically connected to front shell 140. Front connector body 116 defines a first end 126 for receiving a mating triaxial cable connector.

FIGS. 9 to 12 show a second embodiment of a rear portion 114 according to the present invention. Rear portion 114 includes an outer shell 48 and an inner shell 50. Outer shell 48 includes bulkhead mounting threads 42 to facilitate mounting rear portion 114 to an opening 13 (shown in FIG. 13) in bulkhead 12. Opening 13 may be threaded to receive threads 42 or an insert may be provided within opening 13 to receive threads 42. Alternatively, lock nuts may be threaded onto threads 42 to secure rear portion 114 to bulkhead 12. Outer shell 48 also includes first threads 24 for threadably receiving a front connector body, such as front connector body 16 or 116.

Outer shell 48 includes a central opening 49 within which is mounted an insulator 52. Insulator 52 includes a central opening 53 within which is mounted inner shell 50 so that the inner and outer shells are electrically and physically isolated. Inner shell 50 includes second threads 22 for threadably receiving front shell assembly 20. Inner shell 50 also defines a central opening 51 within which is mounted a center conductor insulator 44. Center conductor insulator 44 includes a central opening 45 within which is mounted a center conductor shaft 54. Center conductor shaft 54 includes center conductor mounting stud 34 on a first end and a center conductor contact 56 on a second end. When a front shell assembly 20 or 120 is threaded onto second threads 22, center conductor contact 56 engages center conductor pin 36 or jack 136 to electrically connect with mounting stud 34.

First coaxial conductor mounting studs 32 are mounted to a ring 46 which is positioned about and electrically connected to inner housing 50. Inner housing 50 and outer housing 48 are made of an electrically conductive material. When a front shell assembly 20 or 120 is threadably received by second threads 22, outer shell 40 or 140 is electrically connected with first coaxial connector mounting studs 32 by inner housing 50.

Outer shell 48 has a rear surface 82 adjacent threads 42 and defining a planar rear face. Insulator 52 includes a rear end 76 which when inserted within opening 49 is essentially flush with rear surface 82 of outer shell 48 and defines a rear face of rear portion 114. Mounting studs 32 and 34 extend beyond rear surface 82 and rear end 76 so that they are accessible for attaching to electrical leads, such as leads 4 shown in FIG. 1A inside camera 2. As mounting studs 32 and 34 may be positioned within a case and thereby sheltered from most environmental hazards or impacts and do not need to be covered by additional shields or housings. Since studs 32 and 34 are adapted for directly connecting to leads, no provision is made within rear portions 14, 114 and 214 for crimping to conductors within a jacketed triaxial cable.

Inner housing 50 also include a rear extension 80 which extends beyond rear surface 82 and rear end 76 between mounting studs 32 and 34. Along opposing sides of outer shell 48 are a pair of flats 78. Flats 78 permit better griping of rear portion 114 when mounting rear portion 114 to a bulkhead. If the opening in the bulkhead is threaded to receive threads 42, an installer's fingers or a wrench may be used to grasp flats 78 to aid installation. Flats 78 also improve a user's grip of outer shell 48 when assembling the various components included in rear portion 114.

Figure 13:
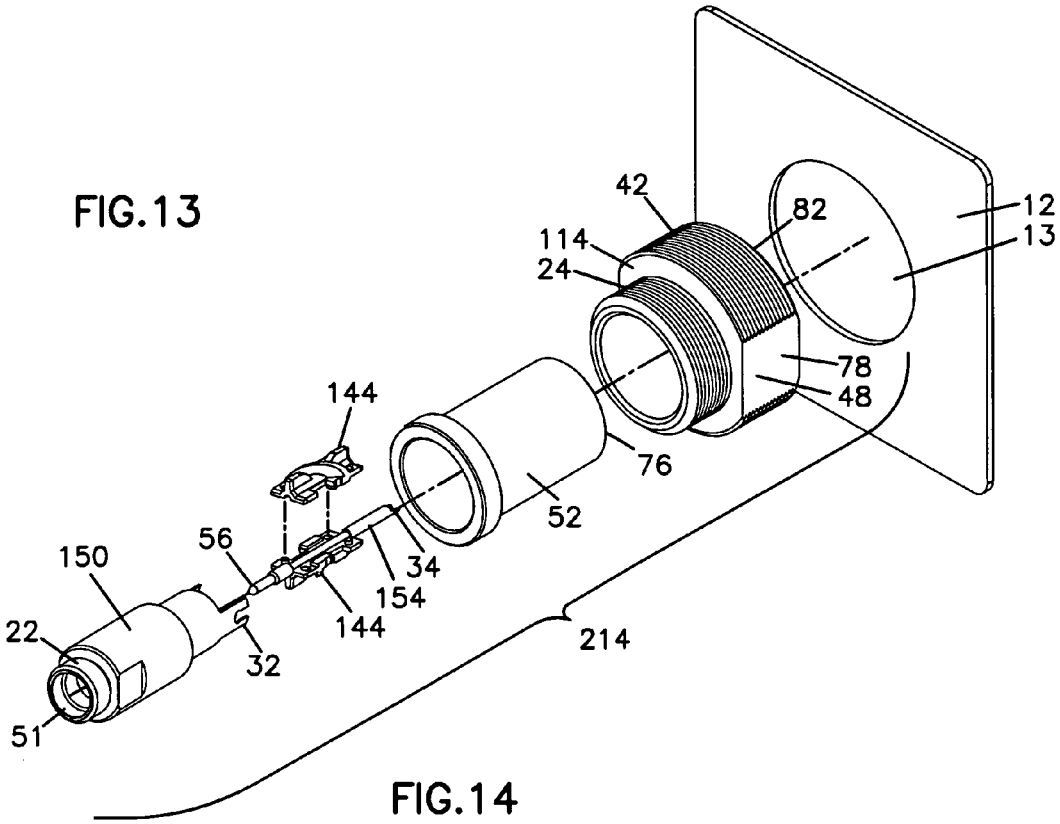
FIG. 13 is an exploded front perspective view of the rear portion of the triaxial connector of FIG. 12.

FIG. 13 shows a third embodiment of a rear portion 214 according to the present invention. Many of the components of rear housing 214 are common with rear housing 114 described above. An inner shell 150 includes first coaxial studs 32 integral with the housing and studs 32 define the rearmost extension of inner shell 150. A center conductor contact 154 is mounted between a pair of insulator halves 144 and is positioned within opening 51 of inner housing 150. In other respects, rear portion 214 and 114 engage kit 30 in the same fashion and are received by bulkhead 12 in the same fashion.

Rear portion 214 also includes a rear face defined by rear surface 82 of outer shell 48 and rear end 76 of insulator 52. Inner shell 150 does not include a rear extension 80 extending beyond this rear face. The rear most portion of inner shell 152 are mounting studs 32 and these along with mounting stud 34 extend beyond the rear face.

Figure 14:
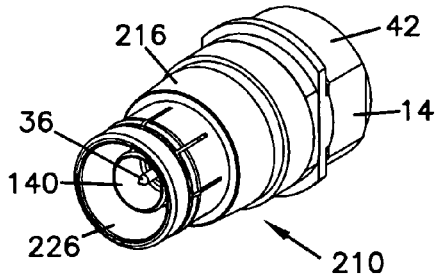
FIG. 14 is a front perspective view of a third embodiment of a triaxial bulkhead connector according to the present invention.
Figure 15:
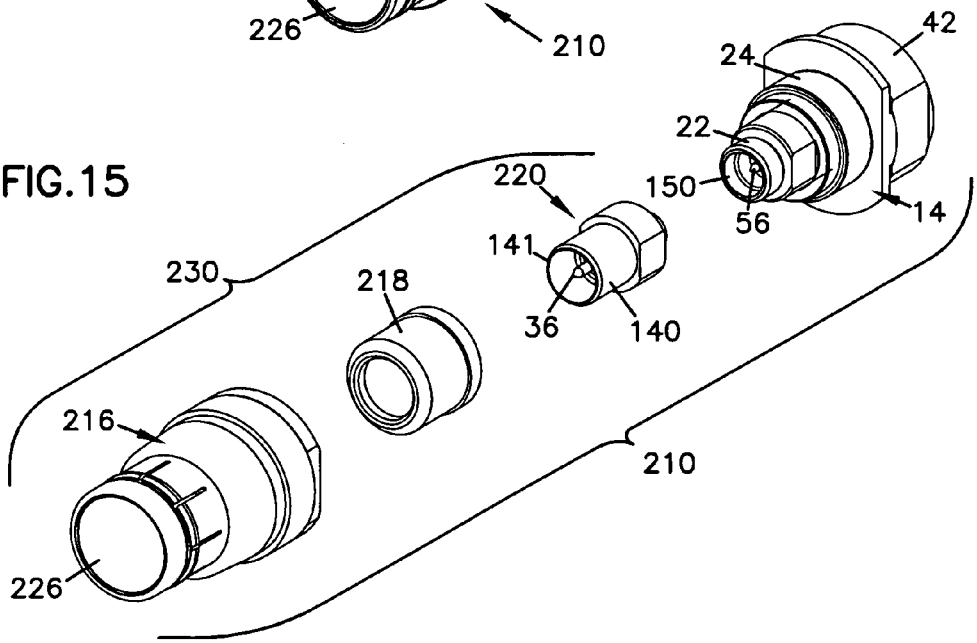
FIG. 15 is a partially exploded front perspective view of the bulkhead connector of FIG. 14.
Figure 16:
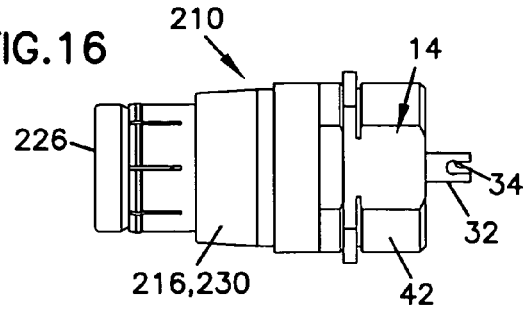
FIG. 16 is a side view of the bulkhead connector of FIG. 14.

Referring now to FIGS. 14 to 16, a third embodiment of a triaxial bulkhead connector 210 including rear portion 14 and a kit 230 with a front shell assembly 220, insulator 218 and a front connector body 216. Front connector body 216 defines a first end 226 for receiving a mating triaxial cable connector. Front shell assembly 220 includes center conductor pin 36 within insulator 38 (not shown) within a front shell 140 defining a solid front end 141. Connector 210 conforms to a different format and gender definition from the style and genders of connector 10 and 110.

Figure 17:
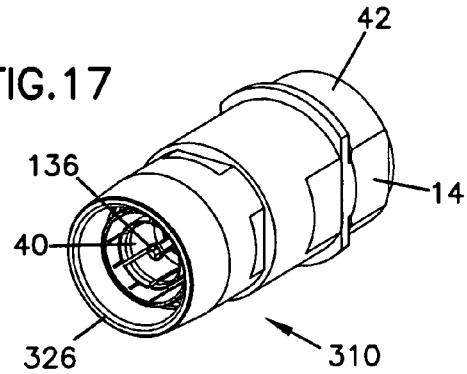
FIG. 17 is a fourth embodiment of a triaxial bulkhead connector according to the present invention.
Figure 18:
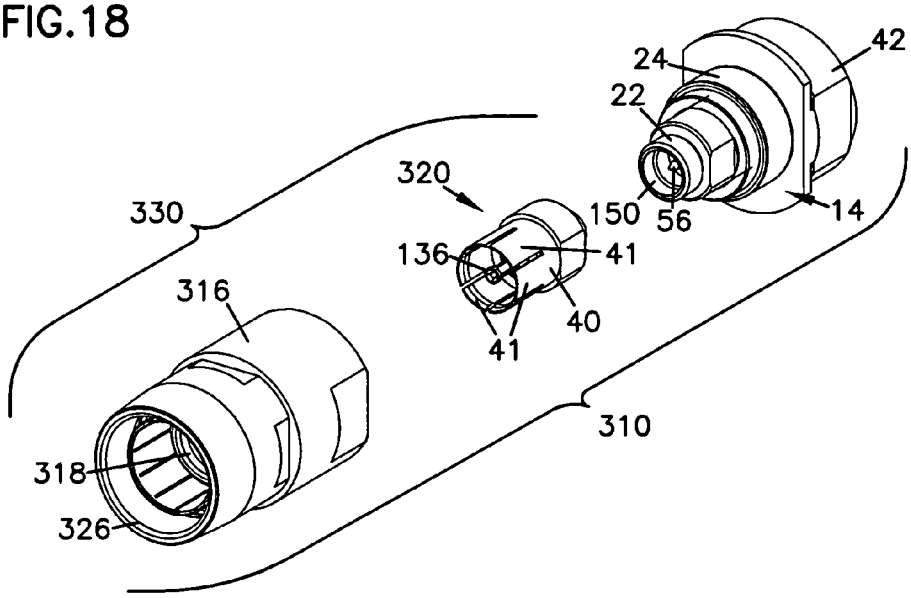
FIG. 18 is a partially exploded front perspective view of the bulkhead connector of FIG. 17.
Figure 19:
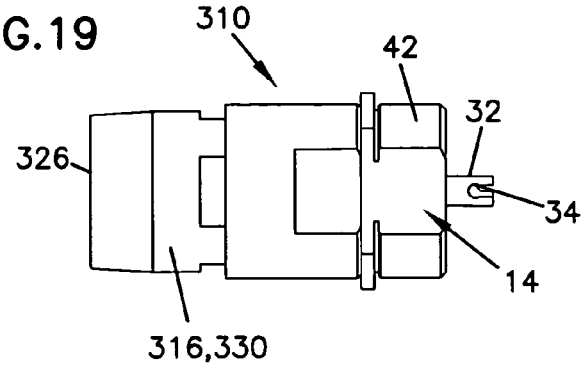
FIG. 19 is a side view of the bulkhead connector of FIG. 17.

Referring now to FIGS. 17 to 19, a fourth embodiment of a triaxial bulkhead connector 310 including rear portion 14 and a kit 330 with a front shell assembly 320, insulator 318 and a front connector body 316. Front connector body 316 defines a first end 326 for receiving a mating triaxial cable connector. Front shell assembly 320 includes center conductor jack 136 within insulator 38 (not shown) within a front shell 40 defining a plurality of fingers 41. Connector 310 conforms to the same format and gender definition as connector 210.

Figure 20:
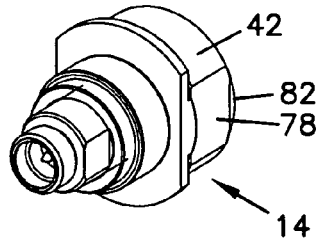
FIG. 20 is a front perspective view of a third embodiment of a rear portion of a triaxial bulkhead connector according to the present invention.
Figure 21:
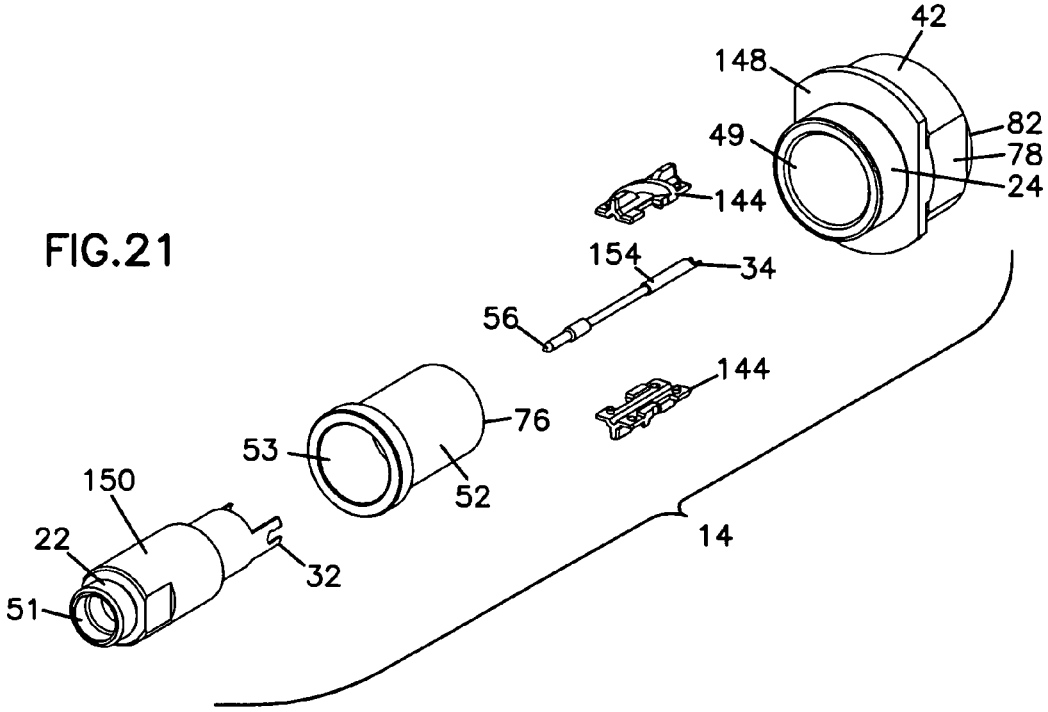
FIG. 21 is an exploded front perspective view of the rear portion of the triaxial connector of FIG. 20.

Referring now to FIGS. 20 and 21 and also to FIG. 4, further detail of rear portion 14 is shown. Rear portion 14 includes an outer shell 148 which includes threads 42 for mounting rear portion 14 within opening 13 to bulkhead 12 and also includes an integral flange 58 which rests against first side 60 of bulkhead 12. If opening 13 includes threads corresponding to threads 42, rear portion 14 can be threaded into opening 13 until flange 58 rests against first side 60. Alternatively, if opening 13 is not threaded, threads 42 of rear portion 14 can be inserted through opening 13 until flange 58 rests against first side 60. Then, a threaded nut, lock ring or other similar fastener threaded fastener can be threaded onto threads 42 until flush against second face 62. Outer shell 148 also includes opposing flats 78 and rear surface 82, as described above with regard to rear portions 114 and 214.

Figure 22:
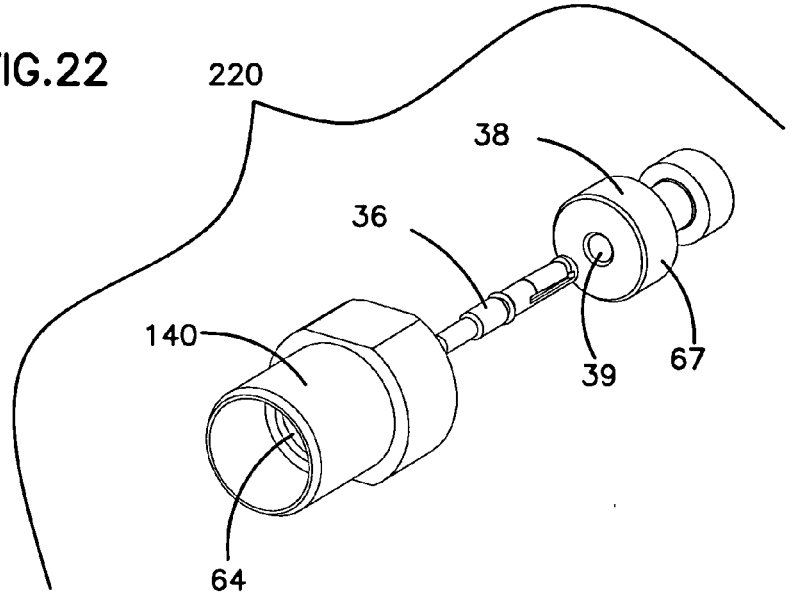
FIG. 22 is an exploded front perspective view of a front shell assembly according to the present invention.
Figure 23:
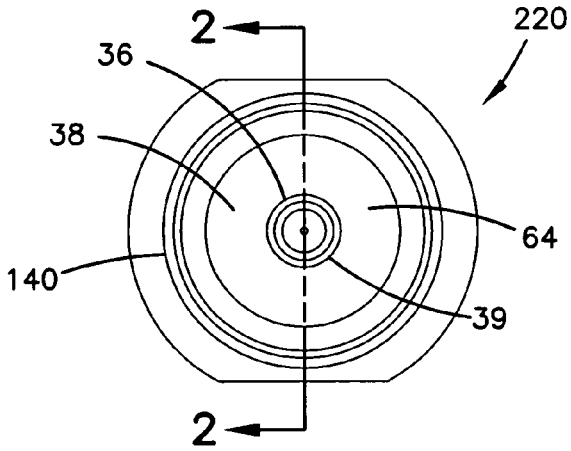
FIG. 23 is a front end view of the front shell assembly of FIG. 22.
Figure 24:
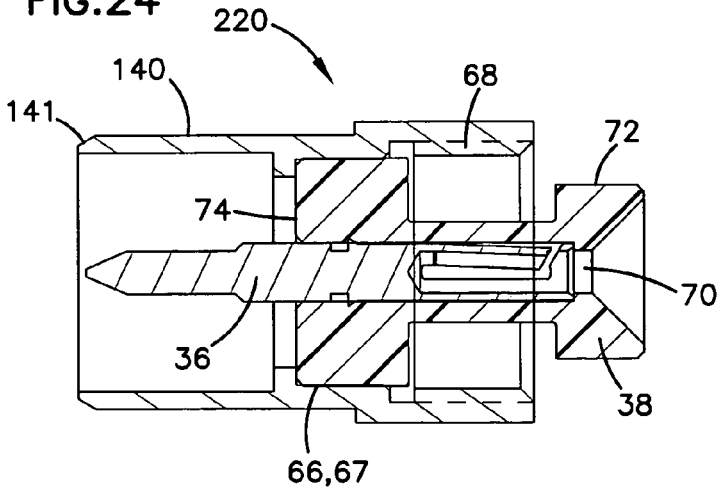
FIG. 24 is a side cross-sectional view of the front shell assembly of FIG. 22, taken along line 2—2 of FIG. 23.

Front shell assembly 220 is shown in further detail in FIGS. 22 to 24. Front shell assembly 220 includes front shell 140 with center conductor pin 36. As shown in the various embodiments above, front shells 40 and 140 can be combined with center conductor pin 36 or center conductor jack 136 to conform to the desired style or gender definition. As other styles and gender formats are defined, front shell assembly 20, 120, 220, 320 can be adapted as needed within the scope of the present invention. Insulator 38 includes a central opening 39 within which center conductor pin 36 is received. Front shell 140 includes a central opening 64 within which insulator 38 is received. Central opening 64 includes a portion 66 for holding a shoulder 67 of insulator 38 and a threaded portion 68 which is threadably received by second threads 22 of rear portions 14 or 114. A rear opening 70 is provided into central opening 39 of insulator 38 which permits center conductor contact 56 of rear portion to physically and electrically connector with center conductor pin 36 when front shell assembly is mounted to rear portion 14.

Center conductor pin 36 extends from a first end 74 of insulator 38 within front shell 140 proximate front end 141. A second opposing end 72 of insulator 38, including opening 70, extends outside of central opening 64 of front shell 140. For each of the alternative embodiments shown for a triaxial bulkhead connector according to the present invention, insulator 38 is used within central opening 64 of either front shell 40 or 140. Insulator 38 also holds center conductor pin 36 or jack 136 is the same relative position within central opening 39, both proximate fingers 41 and front end 141 and with regard to opening 70.

The above specification, examples and data provide a complete description of the manufacture and use of the invention. Since many embodiments of the invention can be made without departing from the spirit and scope of the invention, the invention resides in the claims hereinafter appended.

What is claimed is:

1. A triaxial bulkhead connector rear portion comprising:

an outer shell with a central opening, a rear surface and mounting threads adjacent the rear surface, and first threads adapted to receive a front connector body;

an insulator with a central opening positioned within the central opening of the outer shell having a rear end which cooperates with the rear surface of the outer shell to define a rear face;

an inner shell positioned within the central opening of the insulator with second threads adjacent the first threads, the second threads adapted to receive a front shell assembly, the inner shell including a wire mounting stud opposite the second threads, the wire mounting stud extending beyond the rear face;

the inner shell further including a central opening within which is mounted a center conductor shaft electrically isolated from the inner shell by a center conductor insulator;

the center conductor including a first end with a contact adapted to engage a center conductor of the front shell assembly and a second end with a mounting stud which extends beyond the rear face.

2. The triaxial bulkhead connector rear portion of claim 1, wherein the wire mounting studs of the inner shell are part of a ring which is mounted about a rear extension of the inner shell.

3. The triaxial bulkhead connector rear portion of claim 2, wherein the rear extension of the inner shell extends beyond the rear face.

4. The triaxial bulkhead connector rear portion of claim 1, wherein the wire mounting studs of the inner shell define the rearmost extension of the inner shell.

5. The triaxial bulkhead connector rear portion of claim 1, wherein the outer shell includes a ledge adjacent the mounting threads opposite the rear face.

6. The triaxial bulkhead connector rear portion of claim 1, wherein the outer shell includes a pair of opposing flats between the rear face and the first threads.

* * * * *